US011634918B1

(12) United States Patent
McQuade

(10) Patent No.: US 11,634,918 B1
(45) Date of Patent: Apr. 25, 2023

(54) CATCH MAT

(71) Applicant: Philip McQuade, Annapolis, MD (US)

(72) Inventor: Philip McQuade, Annapolis, MD (US)

( * ) Notice: Subject to any disclaimer, the term of this patent is extended or adjusted under 35 U.S.C. 154(b) by 211 days.

(21) Appl. No.: 17/087,426

(22) Filed: Nov. 2, 2020

Related U.S. Application Data

(60) Provisional application No. 62/930,964, filed on Nov. 5, 2019.

(51) Int. Cl.
*E04G 21/30* (2006.01)
*B05B 12/24* (2018.01)
*B05B 12/22* (2018.01)

(52) U.S. Cl.
CPC ..... *E04G 21/30* (2013.01); *B05B 12/22* (2018.02); *B05B 12/24* (2018.02)

(58) Field of Classification Search
None
See application file for complete search history.

(56) References Cited

U.S. PATENT DOCUMENTS 2,227,453 A 1/1941 Koch
2,850,252 A * 9/1958 Ford ..... B64F 1/36 244/114 R
3,242,509 A * 3/1966 Nissen ..... E04F 15/22 446/901
3,284,819 A 11/1966 Nissen
3,319,273 A * 5/1967 Solin ..... A63B 6/00 473/29
3,518,707 A * 7/1970 Nissen ..... A63B 6/00 182/139
3,636,577 A * 1/1972 Nissen ..... A63B 6/00 5/420
3,862,876 A 1/1975 Graves
4,137,583 A * 2/1979 Baldwin ..... A63B 6/00 5/420
4,193,375 A 3/1980 Sharland
4,263,355 A 4/1981 Sarkisian
4,350,721 A * 9/1982 Nagase ..... A44B 19/34 160/DIG. 18
4,443,283 A 4/1984 Sarkisian
4,500,129 A * 2/1985 Hahn ..... A01G 9/04 383/4
4,712,258 A * 12/1987 Eves ..... A47D 15/008 5/655
5,038,889 A 8/1991 Jankowski
(Continued)

*Primary Examiner* — Jethro M. Pence
(74) *Attorney, Agent, or Firm* — QuickPatents, LLC; Kevin Prince

(57) ABSTRACT

A catch mat for protecting a floor and a wall during construction activities includes two or more cushioning pads each having a top surface, a bottom surface, and four peripheral edges. Each cushioning pad has a first part of a two-part fastener strip fixed along the top surface proximate one of the peripheral edges. A flexible second part of the two-part fastener strip is adapted to engage the first part of the two-part fastener strip of adjacent and abutting cushioning pads to fasten them mutually yet pivotally together. Each cushioning pad further includes at least one resilient masking strip projecting away from one of the peripheral edges of the cushioning pad at the top surface thereof. In use, the cushioning pads, fastened together, are placed on the floor against the wall with the masking strip bent upward against the wall to protect the floor and wall from falling debris.

12 Claims, 3 Drawing Sheets

(56) References Cited

U.S. PATENT DOCUMENTS 5,144,911 A * 9/1992 Moore ..... A01K 1/0353 119/28.5
5,273,316 A 12/1993 Infante
5,489,459 A 2/1996 Nauman
5,654,074 A 8/1997 Smith
5,658,632 A 8/1997 Krabill
5,761,853 A 6/1998 Trosper
5,806,271 A 9/1998 Van Someren
5,930,956 A 8/1999 Trosper
5,970,541 A * 10/1999 Chiang ..... A47G 27/0293 5/420
6,572,949 B1 6/2003 Lewis
6,579,587 B2 6/2003 Schnoebelen, Jr.
6,685,388 B2 2/2004 Webster
6,865,850 B1 3/2005 Campbell
7,691,465 B2 4/2010 Bukovitz
7,774,991 B2 8/2010 Fletcher
8,104,426 B2 * 1/2012 Gringer ..... B05B 12/28 15/245.1
8,104,575 B1 1/2012 Bancroft
8,334,041 B2 12/2012 Sweeney
8,501,295 B2 8/2013 Sweeney
10,156,045 B2 12/2018 Penland
2001/0002615 A1 6/2001 Lacross
2003/0170451 A1 9/2003 Hansen
2004/0050324 A1 3/2004 Copp
2005/0058803 A1 3/2005 Bowden
2008/0029025 A1 2/2008 Nameche
2008/0199628 A1 8/2008 Markowski
2010/0236475 A1 * 9/2010 Bartusiak ..... B05B 12/24 118/505
2010/0263589 A1 10/2010 Dempster
2011/0094443 A1 4/2011 Karaga
2016/0340963 A1 11/2016 Loch
2018/0030666 A1 2/2018 Penland, Jr.
2019/0070624 A1 3/2019 Holt
2019/0119862 A1 4/2019 Penland, Jr.
2019/0284818 A1 9/2019 Penland, Jr.

* cited by examiner

CATCH MAT

CROSS-REFERENCE TO RELATED APPLICATIONS

This application claims the benefit of U.S. Provisional Patent Application 62/930,964, filed on Nov. 5, 2019, and is incorporated herein by reference.

STATEMENT REGARDING FEDERALLY SPONSORED RESEARCH AND DEVELOPMENT

Not Applicable.

FIELD OF THE INVENTION

This invention relates to construction, and more particularly to a cushioned catch mat for painting, drywalling, and other building activities.

BACKGROUND

Home improvement and construction projects have always had the need to keep paint, dust and debris off of floors. Such construction projects typically include painting, carpentry, finishing drywall, mounting televisions, electrical work, and the like. A common method to protect floors and walls during such construction projects is to employ the use of a drop cloth or tarp that is made of fabric or plastic. Such a drop cloth is usually unfolded or unrolled, then placed against the wall or under the work area, so as to catch paint, tools, and debris before hitting the floor.

Drop cloths can be difficult to use for several reasons. Since they are typically made from a thin material they bend and bunch-up, often leaving portions of the floor and wall exposed. To keep them against a wall such drop cloths need to be taped. Corners of walls can be particularly challenging to keep protected. Further, such drop cloths can present a tripping hazard when they are bunched-up. Still further, dumping of caught debris out of a drop cloth is often messy and very difficult to do into a waste receptacle smaller than a dumpster. Folding or rolling cloths for storage is also difficult if alone, and even with help this takes an inordinate amount of time. For all of these reasons and others, some people decide it is not worth the effort to use floor protection and therefore work without such protection, increasing the risk of damaging the floors and walls of their projects.

Therefore, there is a need for a device that is easy to place next to a wall during construction, easily reconfiguring the device as necessary to conform to the particular work area at hand. Such a needed invention would form a seal against the walls to prevent debris from contacting the lower portion of the walls and to protect the floor from falling debris such as paint, drywall dust, or even inadvertently dropped tools. Such a needed device would be easy to fold-up, transport and store, would also be easy to clean, and would be light-weight. The present invention accomplishes these objectives.

SUMMARY OF THE INVENTION

The present device is a catch mat for protecting a floor and a wall during construction activities, such as drywall painting, spackling, taping, texturing, electrical work, and the like. Two or more cushioning pads each have a top surface, a bottom surface, and four peripheral edges.

Each cushioning pad has at least one first part of a two-part fastener strip fixed along the top surface proximate one of the peripheral edges of the cushioning pad. At least one flexible second part of the two-part fastener strip is adapted to engage the first part of the two-part fastener strip of adjacent and abutting cushioning pads to fasten the cushioning pads mutually yet pivotally together. Each cushioning pad further includes at least one resilient masking strip projecting away from one of the peripheral edges of the cushioning pad at the top surface thereof.

As such, in use, with two or more of the cushioning pads when fastened together by the second part of the two-part fastener strip can be placed on the floor against the wall with the masking strip bent upward against the wall to shield a lower portion of the wall and the floor from debris or paint dropped during the construction activities. Each resilient masking strip directs falling debris away from the wall, even for a time after being removed from contact with the wall while the resilient masking strip returns to its normal shape projecting away from the peripheral edge of the cushioning pad. In this way debris is caught by the cushioning pads and does not inadvertently fall onto the floor when the catch mat is pulled away from the wall after use.

In some embodiments one of the cushioning pads is designated a corner cushioning pad and has one of the resilient masking strips on two adjacent peripheral edges. As such, the corner cushioning pad may be placed against a corner of the wall with each resilient masking strip bent upward and meeting in the corner of the wall to protect the corner of the wall.

In some embodiments each cushioning pad has at least one of the first parts of the two-part fastener strip fixed along the bottom surface of the cushioning pad proximate one of the peripheral edges of the cushioning pad. As such, three or more of the cushioning pads may be fixed together with the second part of the two-part fastener strip alternating between the first parts of the two-part fastener strips on the top surface of the cushioning pads and the first parts of the two-part fastener strips on the bottom surfaces, thereby facilitating collapsing of the cushioning pads into a single stack of the cushioning pads for ease of transport and storage.

The present invention is a device that is easy to place next to a wall during construction, and is easy to reconfigure as necessary to conform to the particular work area. The present invention forms a seal against the walls to prevent debris from contacting the lower portion of the walls and to protect the floor from falling debris such as paint, drywall dust, or inadvertently dropped tools. The present device is easy to fold-up, transport and store, and is also light-weight and easy to clean. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
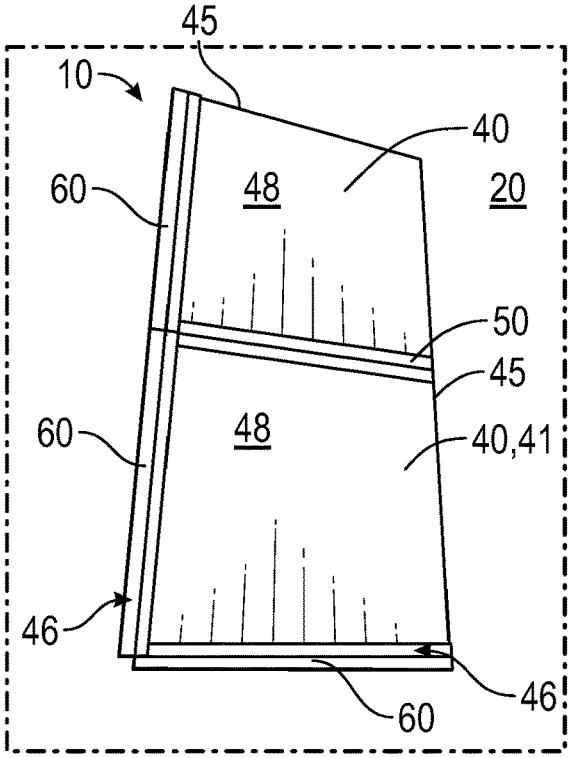
FIG. 1 is a perspective view of two cushioning pads of the invention attached with a two-part fastener strip.
Figure 2:
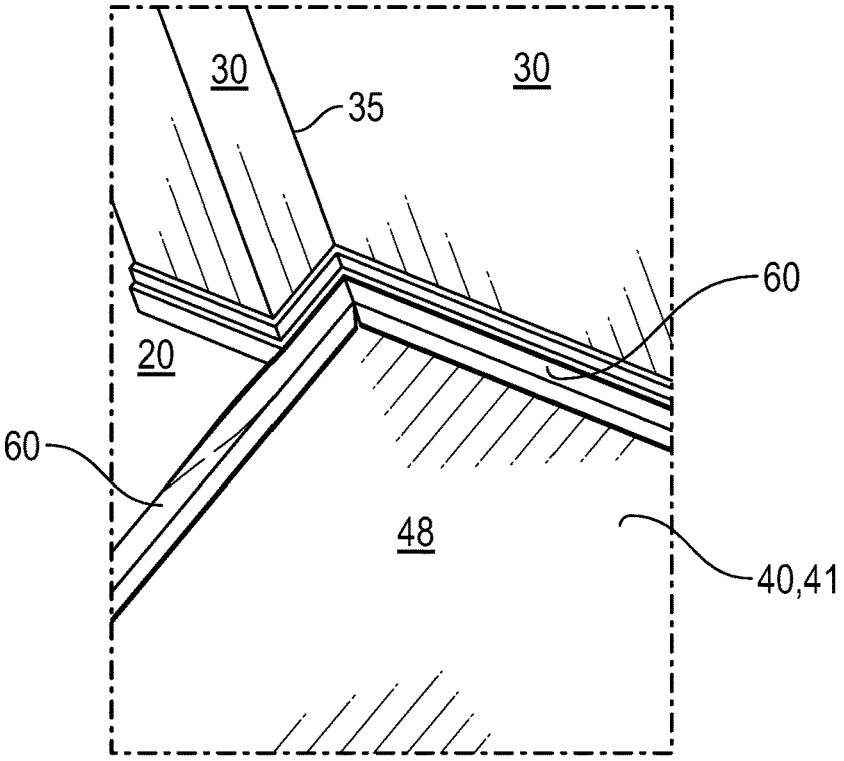
FIG. 2 is a perspective view of a corner cushioning pad protecting a corner of a wall and further protecting a floor surface.

FIGS. 1 and 2 illustrate a catch mat 10 for protecting a floor 20 and a wall 30 during construction activities. Such construction activities might include, for example, drywall painting, spackling, taping, texturing, electrical work, and the like.

Two or more cushioning pads 40, preferably made of either an open-cell or closed-cell foam material, an elastomeric or rubber sheet material, a soft non-brittle plastic sheet material, or the like. Each cushioning pad has a top surface 48, a bottom surface 42, and four peripheral edges 45. Preferably each cushioning pad 40 is substantially square in plan view, with the length of each peripheral edge 45 being substantially identical. Each cushioning pad 40 protects and cushions the floor 20 from large and heavy falling items, even tools such as hammers and screwdrivers.

Figure 4:
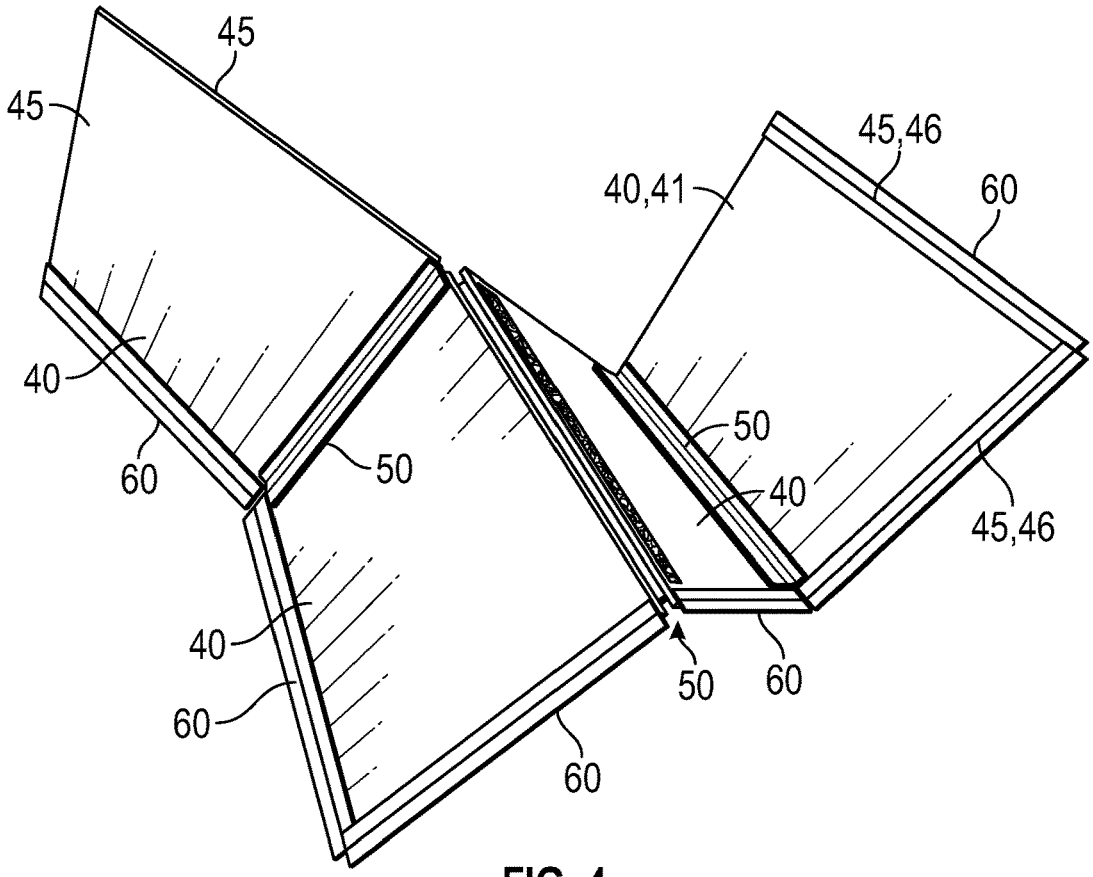
FIG. 4 is a perspective view of four of the cushioning pads attached in such a way as to be easily collapsed into a stack of the cushioning pads.
Figure 5:
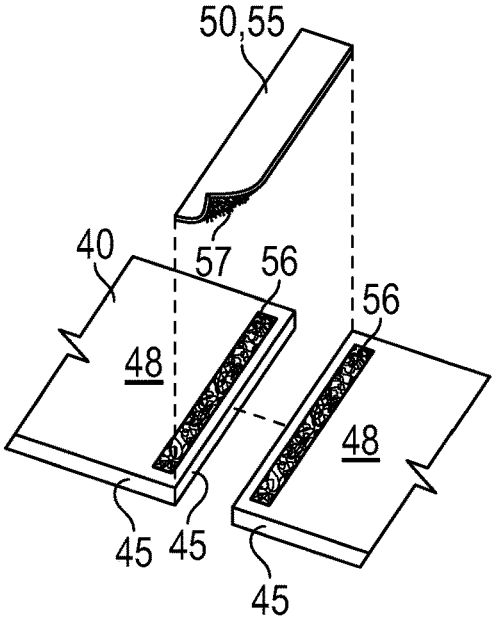
FIG. 5 is a partial and exploded perspective view, showing two first parts of the two-part fastener strip each attached with one of the cushioning pads, the second part of the two-part fastener strip positioned above the cushioning pads and ready to attach each of the two cushioning pads when brought together in an abutting relationship.

Each cushioning pad 40 has at least one first part 51 of a two-part fastener strip 50 fixed along the top surface 48 proximate one of the peripheral edges 45 of the cushioning pad 40. At least one flexible second part 52 of the two-part fastener strip 50 is adapted to engage the first part 51 of the two-part fastener strip 50 of adjacent and abutting cushioning pads 40 (FIGS. 3-5) to fasten the cushioning pads 40 mutually yet pivotally together.

Preferably each two-part fastener strip 50 is a hook-and-loop type fastener strip 55 (FIG. 5), wherein the first part 51 of the two-part fastener strip 50 is a loop part 56 of the hook-and-loop type fastener strip 55, and wherein the second part 52 of the two-part fastener strip 50 is a hook part 57 of the hook-and-loop type fastener strip 55. Alternately, each two-part fastening strip 50 may include mechanical snaps (not shown), zippers (not shown) or the like.

Figure 3:
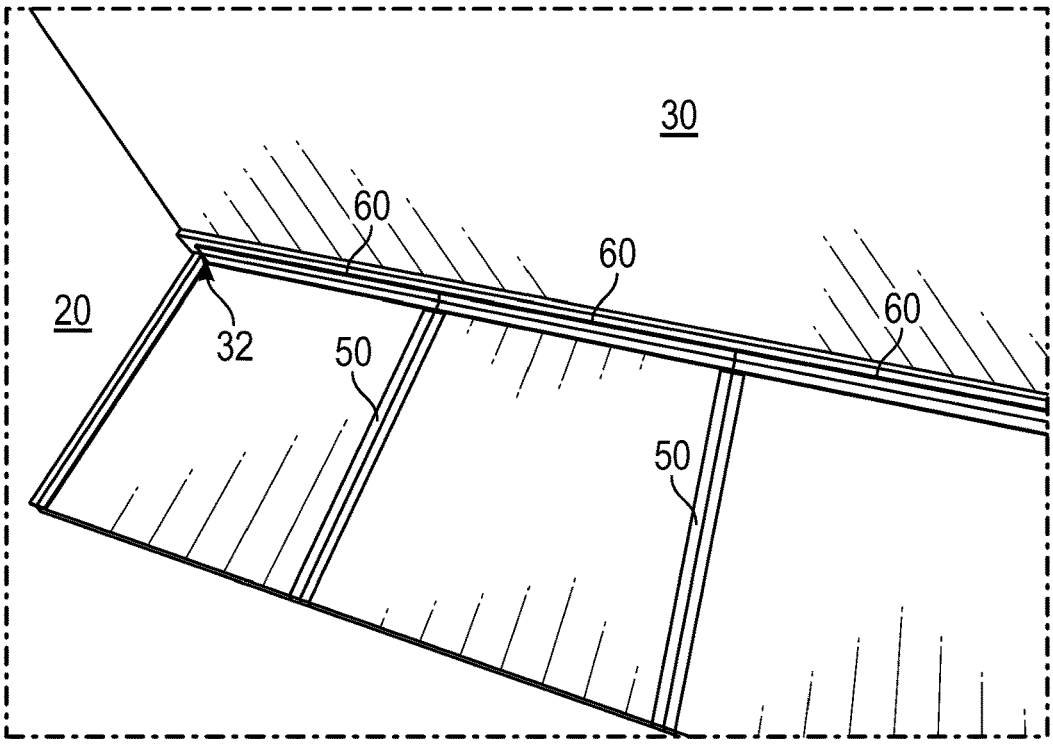
FIG. 3 is a perspective view of a trio of the cushioning pads attached and protecting the wall and floor.
Figure 6:
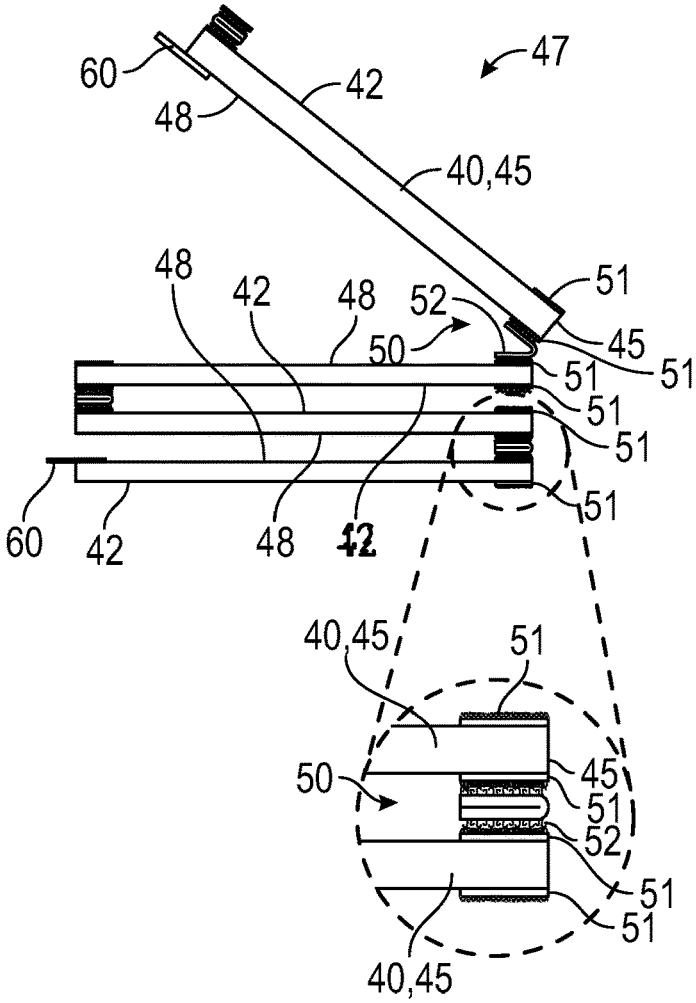
FIG. 6 is a front elevational view of a stack of the cushioning pads.

Each cushioning pad 40 further includes at least one resilient masking strip 60 projecting away from one of the peripheral edges 45 of the cushioning pad 40 at the top surface 48 thereof. Preferably each resilient masking strip 60 is made from an elastomeric rubber material, a resilient or flexible vinyl strip material, or the like. The resiliency of each resilient masking strip 60 is such that when removed from contact the wall 30 the resilient masking strip 60 returns to an original position of projecting away from the peripheral edge 45 of the cushioning pad 40 (FIG. 6), but is not so rigid that it forces the cushioning pad 40 away from the wall 30. Further, preferably each resilient masking strip 60 overhangs a plane of adjacent peripheral edges 45, such that the resilient masking strips 60 of adjacent and connected cushioning pads 40 overlap (FIG. 3).

As such, in use, with two or more of the cushioning pads 40 when fastened together by the second part 52 of the two-part fastener strip 50 can be placed on the floor 20 against the wall 30 with the masking strip 60 bent upward against the wall 30 to shield a lower portion 32 of the wall 30 and the floor 20 from debris or paint dropped during the construction activities. Each resilient masking strip 60 directs falling debris away from the wall 30, even for a time after being removed from contact with the wall 30 while the resilient masking strip 60 returns to its normal shape projecting away from the peripheral edge 45 of the cushioning pad 40. In this way debris is caught by the cushioning pads 40 and does not inadvertently fall onto the floor 20 when the catch mat 10 is pulled away from the wall 30 after use. Further, the catch mat 10 may be flipped upside-down so that the resilient masking strip 60 contacts the floor 20 to shield the floor 20 but substantially none of the wall 30, in the case where the user wishes to paint baseboards or the lower portion 32 of the wall 30. In situations where there the baseboards or trim has carpet (not shown) underneath or there is a slight gap (not shown), the resilient masking strip 60 can be slid under the trim for an added level of protection of the floor 20.

In some embodiments one of the cushioning pads 40 is designated a corner cushioning pad 41 (FIGS. 1-3) and has one of the resilient masking strips 60 on two adjacent peripheral edges 46. As such, the corner cushioning pad 41 may be placed against a corner 35 of the wall 30 with each resilient masking strip bent upward and meeting in the corner 35 of the wall 30 to protect the corner 35 of the wall 30.

In some embodiments each cushioning pad 40 has at least one of the first parts 51 of the two-part fastener strip 50 fixed along the bottom surface 42 of the cushioning pad 40 proximate one of the peripheral edges 45 of the cushioning pad 40. As such, three or more of the cushioning pads 40 may be fixed together with the second part 52 of the two-part fastener strip 50 alternating between the first parts 51 of the two-part fastener strips on the top surface 48 of the cushioning pads 40 and the first parts 51 of the two-part fastener strips 50 on the bottom surfaces 42, thereby facilitating collapsing of the cushioning pads 40 into a single stack 47 (FIG. 6) of the cushioning pads 40.

While a particular form of the invention has been illustrated and described, it will be apparent that various modifications can be made without departing from the spirit and scope of the invention. For example, other shapes of the cushioning pads 40, such as triangles, may be utilized. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A catch mat for protecting a floor and a wall during construction activities, comprising:

two or more cushioning pads each having a top surface, a bottom surface, and four peripheral edges;

each of the two or more cushioning pads having at least one first part of a two-part fastener strip fixed along the top surface proximate one of the four peripheral edges of the respective cushioning pad;

at least one flexible second part of the two-part fastener strip adapted to engage the at least one first part of the two-part fastener strip of adjacent and abutting cushioning pads of the two or more cushioning pads to fasten the adjacent and abutting cushioning pads mutually together;

each of the two or more cushioning pads having at least one resilient masking strip projecting away from one of the four peripheral edges of the respective cushioning pad at the top surface thereof;

whereby two or more of the two or more cushioning pads are configured to be fastened together by the at least one flexible second part of the two-part fastener strip and are further configured to be placed on the floor against the wall with the at least one resilient masking strip bent upward against the wall to shield a lower portion of the wall and the floor from debris dropped during the construction activities.

2. The catch mat of claim 1 wherein each of the two or more cushioning pads is square in plan view.

3. The catch mat of claim 1 wherein the two-part fastener strip of each of the two or more cushioning pads is a hook-and-loop fastener strip, wherein the at least one first part of the two-part fastener strip is a loop part of the hook-and-loop fastener strip and wherein the at least one flexible second part of the two-part fastener strip is a hook part of the hook-and-loop fastener strip.

4. The catch mat of claim 1 wherein one of the two or more cushioning pads designated a corner cushioning pad has one of the at least one resilient masking strips on each of two adjacent of the four peripheral edges, wherein the corner cushioning pad is configured to be placed against a corner of the wall, each respective resilient masking strip meeting in the corner of the wall to protect the corner of the wall.

5. The catch mat of claim 1 wherein each of the two or more cushioning pads is made from a closed-cell cushioning material.

6. The catch mat of claim 1 wherein each of the two or more cushioning pads is made from an open-cell cushioning material.

7. The catch mat of claim 1 wherein each of the at least one resilient masking strip is made from an elastomeric strip material.

8. The catch mat of claim 1 wherein each of the at least one resilient masking strip is made from a vinyl strip material.

9. The catch mat of claim 1 wherein each of the at least one resilient masking strip overhangs planes of adjacent peripheral edges, whereby the at least one resilient masking strip of adjacent and connected cushioning pads of the two or more cushioning pads overlap.

10. The catch mat of claim 1 wherein each of the two or more cushioning pads has at least one of the at least one first parts of the two-part fastener strip fixed along the bottom surface proximate one of the four peripheral edges of the respective cushioning pad, whereby three or more of the two or more cushioning pads are configured to be fixed together with the at least one flexible second part of the two-part fastener strip alternating between the at least one first part of the two-part fastener strips on the top surface and the at least one first part of the two-part fastener strips on the bottom surfaces, thereby facilitating collapsing of the two or more cushioning pads into a single stack of the two or more cushioning pads.

11. A catch mat for protecting a floor and a wall during construction activities, comprising:

two or more square cushioning pads each having a square top surface, a square bottom surface, and four peripheral edges;

each of the two or more square cushioning pads having at least one loop part of a two-part hook-and-loop fastener strip fixed along the square top surface proximate one of the four peripheral edges of the respective square cushioning pad;

at least one flexible hook part of the two-part hook-and-loop fastener strip adapted to engage the at least one loop part of the two-part hook-and-loop fastener strip of adjacent and abutting cushioning pads of the two or more square cushioning pads to fasten the adjacent and abutting cushioning pads mutually together;

each of the two or more square cushioning pads having at least one resilient, elastomeric masking strip projecting away from one of the four peripheral edges of the respective square cushioning pad at the square top surface thereof;

one of the two or more square cushioning pads designated a corner cushioning pad and having one of the at least one resilient, elastomeric resilient masking strips on each of two adjacent peripheral edges of the four peripheral edges;

whereby two or more of the two or more square cushioning pads are configured to be fastened together by the at least one flexible hook part of the two-part hook-and-loop fastener strip and are further configured to be placed on the floor against the wall with the at least one resilient, elastomeric masking strip bent upward against the wall to shield a lower portion of the wall and the floor from debris dropped during the construction activities, the corner cushioning pad configured to be placed against a corner of the wall, each adjacent resilient, elastomeric masking strip of the at least one resilient, elastomeric masking strip meeting in the corner of the wall to protect the corner of the wall.

12. The catch mat of claim 11 wherein each of the two or more square cushioning pads has at least one of the at least one loop parts of the two-part fastener strip fixed along the bottom surface proximate one of the four peripheral edges of the respective square cushioning pad, whereby three or more of the two or more square cushioning pads may be fixed together with the at least one flexible hook part of the two-part fastener strip alternating between the at least one loop part of the two-part fastener strips on the top surface and the at least one loop part of the two-part fastener strips on the bottom surfaces, thereby facilitating collapsing of the two or more square cushioning pads into a single stack of the two or more square cushioning pads.

* * * * *